US011678094B2

(12) United States Patent
Liu

(10) Patent No.: US 11,678,094 B2
(45) Date of Patent: Jun. 13, 2023

(54) FIXATION ASSEMBLY, ELECTRONIC DEVICE, AND WEARABLE ELECTRONIC DEVICE

(71) Applicant: GUANGDONG OPPO MOBILE TELECOMMUNICATIONS CORP., LTD., Guangdong (CN)

(72) Inventor: Enfu Liu, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 0 days.

(21) Appl. No.: 17/176,007

(22) Filed: Feb. 15, 2021

(65) Prior Publication Data

US 2021/0258669 A1 Aug. 19, 2021

(30) Foreign Application Priority Data

Feb. 19, 2020 (CN) ..... 202020187668.2

(51) Int. Cl.
*H04R 1/02* (2006.01)

(52) U.S. Cl.
CPC ..... *H04R 1/02* (2013.01); *H04R 2499/11* (2013.01)

(58) Field of Classification Search
CPC .. H04R 1/02; H04R 2499/11; H04R 2499/15; H04R 1/025
See application file for complete search history.

(56) References Cited

U.S. PATENT DOCUMENTS 6,925,188 B1 8/2005 Markow et al.
8,238,595 B2 * 8/2012 Horowitz ..... H04R 1/345 381/345

(Continued)

FOREIGN PATENT DOCUMENTS

CN 201967110 U 9/2011
CN 208128509 U 11/2018

(Continued)

OTHER PUBLICATIONS

International Search Report for International Application PCT/CN2021/076381 dated Apr. 27, 2021. (4 pages).

(Continued)

*Primary Examiner* — Jason R Kurr
(74) *Attorney, Agent, or Firm* — Young Basile Hanlon & MacFarlane, P.C.

(57) ABSTRACT

A fixation assembly is configured to fix an electroacoustic transducer to a shell of the electronic device, and includes a first support and a second support. The first support defines a receiving space and a sound transmission channel communicating with the receiving space. The electroacoustic transducer is received in the receiving space. The second support is engaged with the first support and configured to restrict freedom of the transducer assembly cooperatively with the first support. Even when the electronic device is under extreme conditions, a relative position between the electroacoustic transducer and the fixation assembly remain unchanged. The second support is engaged with the shell to fix the first support and the electroacoustic transducer with the shell, such that the electroacoustic transducer is fixed relative to the shell, improving reliability of the electronic device under extreme conditions.

18 Claims, 4 Drawing Sheets

(56) References Cited

U.S. PATENT DOCUMENTS

| | | | | |
|---|---|---|---|---|
| 10,375,469 | B2 * | 8/2019 | Qin | H04R 1/025 |
| 11,064,273 | B2 * | 7/2021 | de la Fuente | H01Q 1/22 |
| 2002/0141164 | A1 * | 10/2002 | Watanabe | H04R 5/02 361/749 |
| 2015/0304747 | A1 * | 10/2015 | Wang | H04R 1/2819 381/345 |
| 2016/0323003 | A1 * | 11/2016 | Shi | H04B 1/3888 |
| 2017/0111719 | A1 * | 4/2017 | Fang | H04R 1/026 |
| 2019/0025133 | A1 * | 1/2019 | Lee | G01K 1/16 |
| 2019/0110131 | A1 | 4/2019 | Kitamura et al. | |
| 2021/0006905 | A1 * | 1/2021 | Yan | H04R 1/025 |
| 2021/0314689 | A1 * | 10/2021 | Kim | G06F 1/1688 |

FOREIGN PATENT DOCUMENTS

| | | | |
|---|---|---|---|
| CN | 110166909 | A | 8/2019 |
| CN | 209390337 | U | 9/2019 |
| CN | 211630640 | U | 10/2020 |
| WO | 2020017738 | A1 | 1/2020 |

OTHER PUBLICATIONS

Extended European Search Report for EP Application 21156809.2 dated Jun. 7, 2021. (11 pages).

* cited by examiner

FIXATION ASSEMBLY, ELECTRONIC DEVICE, AND WEARABLE ELECTRONIC DEVICE

CROSS-REFERENCE TO RELATED APPLICATION(S)

The present application claims priority of Chinese Patent Application No. 202020187668.2, filed on Feb. 19, 2020, the contents of which are hereby incorporated by reference in their entireties.

TECHNICAL FIELD

The present disclosure relates to the field of electronic devices, and in particular to a fixation assembly, an electronic device, and a wearable electronic device.

BACKGROUND

With the gradual popularization of electronic devices, electronic devices have become indispensable social and entertainment tools in people's daily lives, and users have increasing higher requirements for electronic devices. In terms of waterproof performance, electronic devices have experienced IPX5, IPX6, and IPX7 levels. Currently, it is even more necessary for the electronic device to have the waterproof performance of 5 ATM or even 10 ATM. Further, it is desired that the waterproof performance of the electronic devices may not be dramatically reduced under extreme conditions such as being dropped, being impacted, and so on.

SUMMARY

According to a first aspect of the present disclosure, a fixation assembly is provided and configured to fix an electroacoustic transducer to a shell of an electronic device. The fixation assembly includes a first support and a second support. The first support defines a receiving space and a sound transmission channel communicating with the receiving space, and the electroacoustic transducer is received in the receiving space. The second support is engaged with the first support and configured to restrict freedom of the transducer assembly cooperatively with the first support. The second support is configured with the shell to fix the first support and the electroacoustic transducer to the shell. The sound transmission channel communicates with a sound transmission hole defined in the shell.

According to a second aspect of the present disclosure, an electronic device is provided and includes: a shell, an electroacoustic transducer, and a fixation assembly. The shell defines a sound transmission hole. The fixation assembly includes a first support and a second support. The first support defines a receiving space and a sound transmission channel communicating with the receiving space. The electroacoustic transducer is received in the receiving space. The second support is engaged with the first support and is configured to clamp the electroacoustic transducer cooperatively with the first support to restrict the freedom of the electroacoustic transducer. The second support is engaged with the shell to fix the first support and the electroacoustic transducer to the shell, enabling the sound transmission channel to communicate with the sound transmission hole.

According to a third aspect of the present disclosure, a wearable electronic device is provided and includes: a shell, an electroacoustic transducer, a fixation assembly, and a display module. The display module is engaged with the shell to define a chamber to receive the fixation assembly. The fixation assembly includes first support and a second support, the first support and the second support are fastened with each other to define a receiving space, the electroacoustic transducer is received in the receiving space and is clamped by the first support and the second support cooperatively. The shell defines a sound transmission hole, and the first support defines a sound transmission channel communicating with the sound transmission hole and the receiving space.

According to the present disclosure, the fixation assembly is configured to fix an electroacoustic transducer to a shell of an electronic device. The fixation assembly includes a first support and a second support. The first support defines a receiving space and a sound transmission channel communicating with the receiving space. The receiving space may be defined to receive the electroacoustic transducer. The sound transmission channel may communicate with a sound transmission hole of the shell. The second support may be engaged with the first support. The first support and the second support are engaged with each other to cooperatively restrict freedom of the electroacoustic transducer, such that a relative position between the electroacoustic transducer and the fixation assembly remains unchanged. Even when the electronic device is under an extreme condition, such as being dropped, impacted, and so one, the electroacoustic transducer and the fixation assembly may not be misplaced. The second support may be configured with the shell to fix the first support and the electroacoustic transducer with the shell. In this way, the electroacoustic transducer may be fixed relative to the shell, in order to improve reliability of the electronic device under the extreme condition, such as being dropped, impacted, and so on.

BRIEF DESCRIPTION OF DRAWINGS

In order to clearly illustrate technical solutions of embodiments of the present disclosure, accompanying drawings for illustrating the embodiments will be introduced briefly. Obviously, the accompanying drawings in the following illustrate only some embodiments of the present disclosure. Any ordinary skilled person in the art may obtain other drawings based on the following drawings without making any creative work.

DETAILED DESCRIPTION

Figure 1:
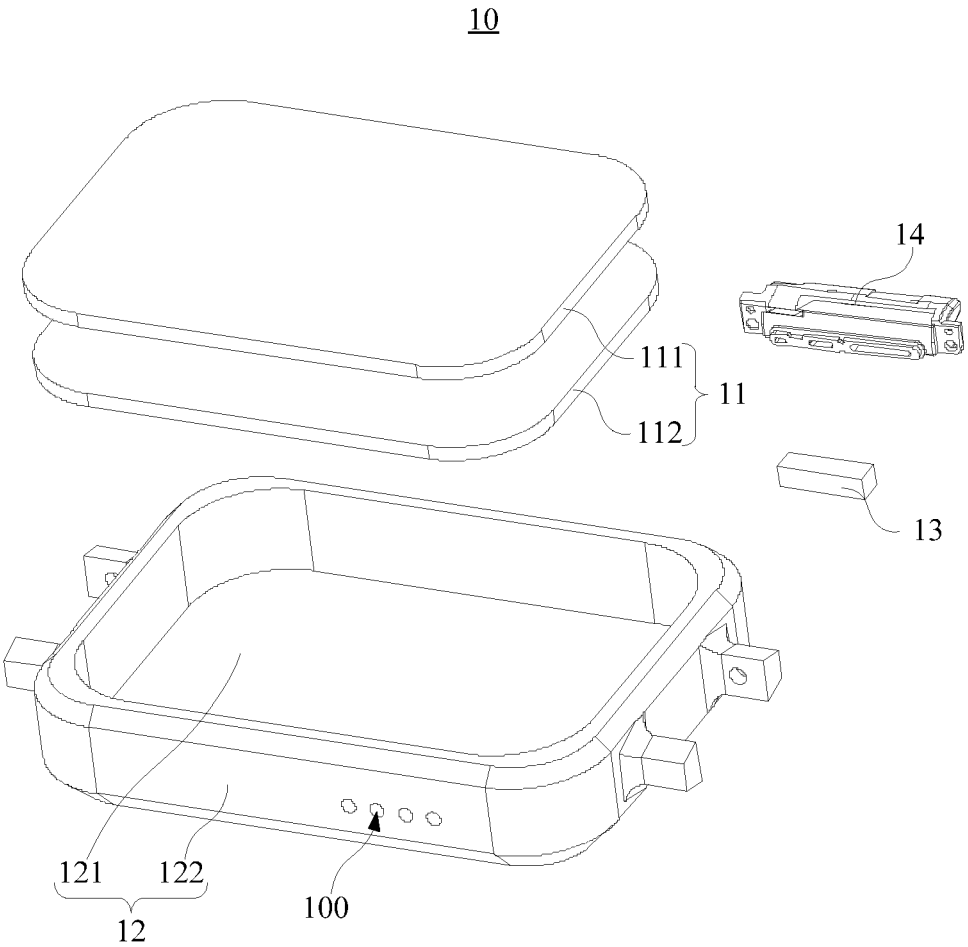
FIG. 1 is an exploded view of an electronic device according to an embodiment of the present disclosure.

Technical solutions of embodiments of the present disclosure may be illustrated by referring to the drawings of the embodiments of the present disclosure. Specifically, the embodiments hereinafter will be described for illustrating the present disclosure, but do not limit the scope of the present disclosure. Similarly, the embodiments hereinafter are only a part of, but not all of, the embodiments of the present disclosure. Any ordinary skilled person in the art may obtain other embodiments without making any creative work, and the obtained other embodiments should also be included within the scope of the present disclosure.

The term "embodiment" used in the present disclosure indicate that specific characteristics, structures, or properties described by referring to the embodiments may be included in at least one embodiment of the present disclosure. Ordinary skilled persons in the art may implicitly and explicitly understand that the embodiments described in the present disclosure may combine with other embodiments.

The applicant discovers through long-term research that an electronic device is typically configured with a speaker and a loudspeaker and a microphone. The loudspeaker may be configured to transduce an electronic signal into an acoustic signal. In order to enable a user to hear a sound generated from the electronic device, a shell of the electronic device may define a through hole correspondingly. The microphone may be configured to transduce the acoustic signal into the electronic signal. In order to enable the electronic device to collect an environmental sound and/or the user's sound, and so on, the shell of the electronic device may define another through hole correspondingly. Further, when the electronic device is under an extreme condition, such as being dropped, impacted, and so on, the loudspeaker, the microphone, and the shell which have been engaged together may be misplaced. Due to the through holes as mentioned above, an internal space of the electronic device may communicate with an outer environment of the electronic device, such that waterproof performance of the electronic device may be affected, resulting in poor reliability of the electronic device. Therefore, the present disclosure provides following embodiments.

According to a first aspect of the present disclosure, a fixation assembly is provided and configured to fix an electroacoustic transducer to a shell of an electronic device. The fixation assembly includes a first support and a second support. The first support defines a receiving space and a sound transmission channel communicating with the receiving space, and the electroacoustic transducer is received in the receiving space. The second support is engaged with the first support and configured to restrict freedom of the transducer assembly cooperatively with the first support. The second support is configured with the shell to fix the first support and the electroacoustic transducer to the shell. The sound transmission channel communicates with a sound transmission hole defined in the shell.

In some embodiments, the second support is fastened with the first support, and the first support and the second support are configured to clamp the electroacoustic transducer.

In some embodiments, a direction along which the second support is fastened with the first support is non-parallel to a direction along which the second support is engaged with the shell.

In some embodiments, the first support includes a bottom wall, a first side wall, and a second side wall; the first side wall and the second side wall are connected to a same side of the bottom wall and extending towards a same side of the bottom wall, the first side wall and the second side wall are disposed opposite to each other. The receiving space is defined by the first side wall, the second side wall, and the bottom wall. The sound transmission channel is defined in the bottom wall. A face of the first side wall opposite to the receiving space is configured with a first protrusion, a face of the second side wall opposite to the receiving space is configured with a second protrusion. The second support includes a body portion, a first barb, and a second barb. The first barb and the second barb are connected to the body portion. When the second support is fastened with the first support, the body portion is configured to cover the face of the first side wall opposite to the receiving space and the face of the second side wall opposite to the receiving space, the first barb is fastened with the first protrusion, and the second barb is fastened with the second protrusion.

In some embodiments, the second support further includes a first connection portion and a second connection portion, the first connection portion and the second connection portion are connected to the body portion and extending towards a same side of the body portion. The first connection portion and the second connection portion are disposed opposite to each other. The first barb is disposed at an end of the first connection portion away from the body portion, the second barb is disposed at an end of the second connection portion away from the body portion. The second support further includes a first engaging portion and a second engaging portion. The first engaging portion is connected to the first connection portion, the second engaging portion is connected to the second connection portion. The first engaging portion and the second engaging portion are configured to engage with the shell. A direction along which the first engaging portion is engaged with the shell is perpendicular to a direction along which the first barb is fastened with the first protrusion. A direction along which the second engaging portion is engaged with the shell is perpendicular to a direction along which the second barb is fastened with the second protrusion.

In some embodiments, the face of the first side wall opposite to the receiving space is configured with a guiding protrusion, and the face of the second side wall opposite to the receiving space is configured with another guiding protrusion. A first face of the first connection portion defines a guiding groove corresponding to the guiding protrusion configured with the first side wall, the first face is opposite to the second connection portion. A second face of the second connection portion is configured with another guiding groove corresponding to the another guiding protrusion configured with the second side wall, the second face is opposite to the first connection portion. An extending direction of the guiding protrusion and an extending direction of the guiding groove are parallel to the direction along which the second support is fastened with the first support.

In some embodiments, the first support further includes a third side wall and a fourth side wall, the third side wall and the fourth side wall are connected to the bottom wall and extending towards a same side of the bottom wall, the third side wall and the fourth side wall are disposed opposite to each other, and the first side wall, the second side wall, the third side wall, the fourth side wall, and the bottom wall define the receiving space cooperatively.

In some embodiments, the first support further includes a sealing portion, protruding from the third side wall. The sealing portion is disposed at a face of the side wall opposite to the receiving space. The sound transmission channel is further extended through the sealing portion. When the second support fixes the first support and the electroacoustic transducer to the shell, the sealing portion is configured to abut against the shell, enabling the sound transmission channel to communicate with the sound transmission hole.

In some embodiments, the first support further includes a partition wall connected to the bottom wall. An end of the partition wall is connected to the third side wall, the other end of the partition wall is connected to the fourth side wall. The receiving space is partitioned by the partition wall into a first receiving sub-space and a second receiving sub-space. Each of the first receiving sub-space and the second receiving sub-space is defined to receive the electroacoustic transducer.

According to a second aspect of the present disclosure, an electronic device is provided and includes: a shell, an electroacoustic transducer, and a fixation assembly. The shell defines a sound transmission hole. The fixation assembly includes a first support and a second support. The first support defines a receiving space and a sound transmission channel communicating with the receiving space. The electroacoustic transducer is received in the receiving space. The second support is engaged with the first support and is configured to clamp the electroacoustic transducer cooperatively with the first support to restrict the freedom of the electroacoustic transducer. The second support is engaged with the shell to fix the first support and the electroacoustic transducer to the shell, enabling the sound transmission channel to communicate with the sound transmission hole.

In some embodiments, the first support includes a bottom wall, a first side wall, a second side wall, a third side wall, and a fourth side wall. The first side wall, the second side wall, the third side wall, and the fourth side wall are connected to the bottom wall and are extending towards a same side of the bottom wall. The bottom wall, the first side wall, the second side wall, the third side wall, and the fourth side cooperatively define the receiving space to receive the electroacoustic transducer. The sound transmission channel is defined in the bottom wall.

In some embodiments, a face of the first side wall opposite to the receiving space is configured with a first protrusion, a face of the second side wall opposite to the receiving space is configured with a second protrusion. The second support includes a body portion, a first barb, and a second barb, the first barb and the second barb are connected to the body portion. The body portion is configured to cover the face of the first side wall opposite to the receiving space and the face of the second side wall opposite to the receiving space, the first barb is fastened with the first protrusion, and the second barb is fastened with the second protrusion.

In some embodiments, the face of the first side wall opposite to the receiving space is configured with a guiding protrusion, the face of the second side wall opposite to the receiving space is configured with another guiding protrusion. An end of the body portion close to the first barb defines a guiding groove corresponding to the guiding protrusion configured with the first side wall. Another end of the body portion close to the second barb defines another guiding groove corresponding to the guiding protrusion configured with the second side wall.

In some embodiments, the second support further includes a first engaging portion and a second engaging portion. The first engaging portion is connected to the end of the body portion close to the first barb, the second engaging portion is connected to the another end of the body portion close to the second barb. The first engaging portion and the second engaging portion are configured to engage with the shell. A direction along which the first engaging portion is engaged with the shell is perpendicular to a direction along which the first barb is fastened with the first protrusion. A direction along which the second engaging portion is engaged with the shell is perpendicular to a direction along which the second barb is fastened with the second protrusion.

In some embodiments, the first support further includes a sealing portion, protruding from a face of the third side wall opposite to the receiving space. The sound transmission channel is defined in and extended through the sealing portion. The sealing portion is configured to abut against the shell, allowing the sound transmission channel to communicate with the sound transmission hole.

In some embodiments, the first support further includes a partition wall connected to the bottom wall. An end of the partition wall is connected to the third side wall, the other end of the partition wall is connected to the fourth side wall. The receiving space is partitioned by the partition wall into a first receiving sub-space and a second receiving sub-space. A portion of the electroacoustic transducer is received in the first receiving sub-space, and the reset portion of the electroacoustic transducer is received in the second receiving sub-space.

In some embodiments, a part of the partition wall is disposed out of the second receiving sub-space and configured to define the first receiving sub-space. Another second protrusion is configured on the part of the partition wall out of the second receiving sub-space and is configured on a face of the part of the partition wall opposite to the first receiving sub-space. The second support further includes another second barb corresponding to the another second protrusion and able to fasten with the another second protrusion.

In some embodiments, the sealing portion includes at least one reinforcement rib, the sound transmission channel is partitioned by the at least one reinforcement rib into a plurality of sub-channels, each of the plurality of sub-channels communicates with the sound transmission hole defined in the shell.

According to a third aspect of the present disclosure, a wearable electronic device is provided and includes: a shell, an electroacoustic transducer, a fixation assembly, and a display module. The display module is engaged with the shell to define a chamber to receive the fixation assembly. The fixation assembly includes first support and a second support, the first support and the second support are fastened with each other to define a receiving space, the electroacoustic transducer is received in the receiving space and is clamped by the first support and the second support cooperatively. The shell defines a sound transmission hole, and the first support defines a sound transmission channel communicating with the sound transmission hole and the receiving space.

In some embodiments, the second support is configured to engage with the shell to fix the first support and the electroacoustic transducer with the shell; and a direction along which the second support is fastened with the first support is non-parallel to a direction along which the second support is engaged with the shell.

As shown in FIG. 1, FIG. 1 is an exploded view of an electronic device according to an embodiment of the present disclosure.

In the present embodiment of the present disclosure, the electronic device 10 may be a portable device, such as a mobile phone, a tablet computer, a notebook computer, a wearable device, and so on. In the present embodiment, the wearable device may be taken as an example of the electronic device 10 and illustratively described. For example, in details, the electronic device 10 may be a smart watch and worn on a wrist of the user. The smart watch may provide a showing function for the user, such as showing a calendar, showing time, and so on. Further, the smart watch may provide a communication function for the user, such as voice calls, video calls, and so one. Further, the smart watch may monitor data index of the user, such as daily exercises of the user, health conditions of the user, and so on. In addition, the electronic device 10 may provide other services, such as payment, identity authentication, which will not be listed hereinafter.

As shown in FIG. 1, the electronic device 10 may include a display module 11, a shell 12, an electroacoustic transducer 13, and a fixation assembly 14. The display module 11 may be engaged with the shell 12 by any one or a combination of mounting, bonding, welding, and so on. The display module 11 and the shell 12 may cooperatively define a chamber with a certain volume. The electroacoustic transducer 13 and the fixation assembly 14 may be received in the chamber. Further, other components, such as a battery, a main board, an antenna, a camera, a motion sensor, a heart rate sensor, a near-field communication element, and so on, may also be received in the chamber to enable the electronic device 10 to achieve corresponding functions. It should be noted that a position at which the display module 11 is engaged with the shell 12 may be treated to achieve waterproof, for example, by configuring a seal ring, dispensing, and so on (not shown in the drawings). In this way, the electronic device 10 may meet the waterproof requirement. In the present embodiment, the electroacoustic transducer 13 may be a loudspeaker and/or a microphone. The electroacoustic transducer 13 may have a regular outer shape, such as a cubic shape, a rectangular shape, a cylindrical shape. Alternatively, the electroacoustic transducer 13 may have other irregular outer shapes. In order to allow the sound generated by electroacoustic transducer 13 to be transmitted to an outer environment, and/or allow the sound in the outer environment to be transmitted to and collected by the electroacoustic transducer 13, the shell 12 may define a sound transmission hole 100 at a corresponding position, enabling the sound to be transmitted easily. The electroacoustic transducer 13 may be waterproof at some extent. Further, the fixation assembly 14 may be configured to enable the electroacoustic transducer 13 to be fixed on the shell 12, in order to improve the waterproof effect of the position between the electroacoustic transducer 13 and the shell 12 (especially the position near the sound transmission hole 100). Detailed structures of the fixation assembly 14 will be described hereinafter.

Generally, the display module 11 may be a liquid crystal display (LCD)-type screen, an organic light-emitting diode (OLED)-type screen, a mini-LED-type screen, or a micro-LED-type screen. The display module 11 may include a transparent cover 111 and a display panel 112, as shown in FIG. 1. The transparent cover 111 may configured to protect the display panel 112, and may serve as an outer surface of the electronic device 10, such that the user may perform touch operations, such as clicking, sliding, pressing, and so on. A material of the transparent cover 111 may be a rigid material, such as glass and so on. Alternatively, the material of the transparent cover 111 may be a flexible material, such as polyimide (PI), colorless polyimide (CPI), and so on. The display panel 112 may be configured to display images, and may serve as an interface to indicate the user to perform the above-mentioned touch operations on the transparent cover 111. The display panel 112 may be adhered to the transparent cover 111 via adhesives, such as via an optically clear adhesive (OCA), a pressure sensitive adhesive (PSA), and so on. In other embodiments, a functional film, such as any one of a tempered safety glass film, a matting film, a decoration film, a privacy film, a hydraulic film, and so on, may be disposed on an outer surface of the electronic device 10 (i.e. an outer surface of the transparent cover 111), such that the electronic device 10 may exhibit various effects for the user.

A material of the shell 12 may be a rigid material, such as glass, metal, rigid plastics, and so on. A watch strap (not shown in the figure) may be arranged with the shell 12 to enable the electronic device 10 to be easily worn by the user. In other embodiments, the material of the shell 12 may be a flexible material, such as PI, CPI, and so on, and in combination with a flexible display module 11, the electronic device 10 may be able to be bent to be worn onto the wrist of the user directly. In addition, as the shell 12 may usually be exposed to the outer environment, the material of the shell 12 may preferably be abrasion-proof, erosion-proof, scratching-proof, and so on. Alternatively, a layer of functional materials, which are abrasion-proof, erosion-proof, and scratching-proof, may be coated on an outer surface of the shell 12 (i.e. an outer surface of the electronic device 10). The shell 12 may include a back plate 121 and a middle frame 122. The back plate 121 and the middle frame 122 may be connected to define an opening and a cavity with a certain volume, such that the shell 12 and the display module 11 may be engaged to cooperatively define the chamber as mentioned above. In some embodiments, the back plate 121 and the middle frame 122 may be an overall and integral element formed by injection molding, pressing, thermal-siphoning, and so on. In other embodiments, the back plate 121 and the middle frame 122 may be two individual elements, and may be engaged by any one or a combination of mounting, bonding, welding, and so on.

Figure 2:
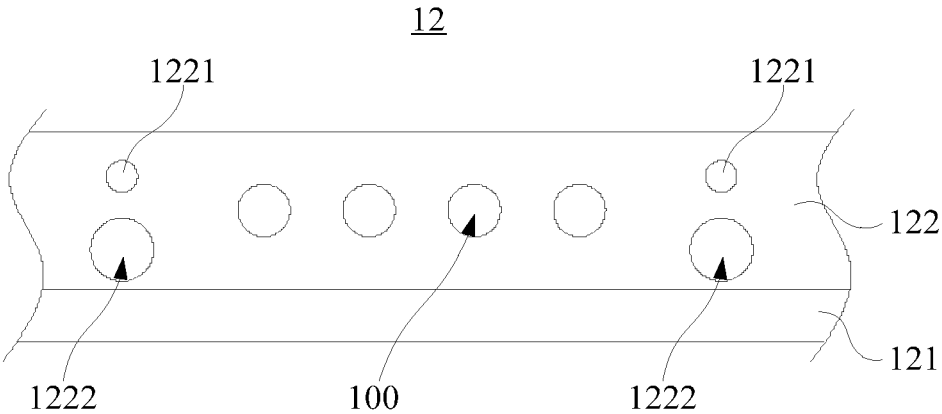
FIG. 2 is a front schematic view of a portion of a shell near a sound transmission hole according to the embodiment shown in FIG. 1.

As shown in FIG. 2, FIG. 2 is a front schematic view of a portion of the shell near the sound transmission hole according to the embodiment shown in FIG. 1. It should be noted that FIG. 2 shows a viewing angle from an inside of the shell to an outside of the shell.

In the present embodiment, as the back plate 121 may be configured to contact the wrist of the user, the sound transmission hole 100 may be defined in the middle frame 122 to allow the sound to be transmitted through the sound transmission hole easily. As shown in FIG. 2, the sound transmission hole 100 may include a plurality of round holes without communicating with each other. A diameter of each of the plurality of round holes may be less than or equal to 1.5 mm, such that the sound may be transmitted through the sound transmission hole 100, and at the same time, the waterproof requirement may be met. In other embodiments, the sound transmission hole 100 may be strip shaped, and that is, the plurality of round holes are communicating with each other.

As shown in FIG. 2, the middle frame 122 may be configured with a positioning post 1221 and define a first mounting hole 1222. The first mounting hole 1222 may be a hole having threads on a wall of the hole, a hole for fastening, and so on. Further, while the fixation assembly 14 is being engaged with the shell 12, a way of using the positioning post 1221 and the first mounting hole 1222 may be described in more details hereinafter. The positioning post 1221 may be configured to improve accuracy of engaging the fixation assembly 14 with the shell 12, and the first mounting hole 1222 may be defined to allow the fixation assembly 14 to be fixedly connected to the shell 12. In this situation, the middle frame 122 may be configured with two sets of positioning posts 1221 and first mounting holes 1222. As shown in FIG. 2, one of the two sets of positioning posts 1221 and first mounting holes 1222 may be disposed and defined on one side of the sound transmission hole 100, and the other one of the two sets of positioning posts 1221 and first mounting holes 1222 may be disposed and defined on another side of the sound transmission hole 100.

In the following, detailed structure of the fixation assembly 14 and the means of the electroacoustic transducer 13 being fixed with the shell 12 will be described hereinafter.

Figure 3:
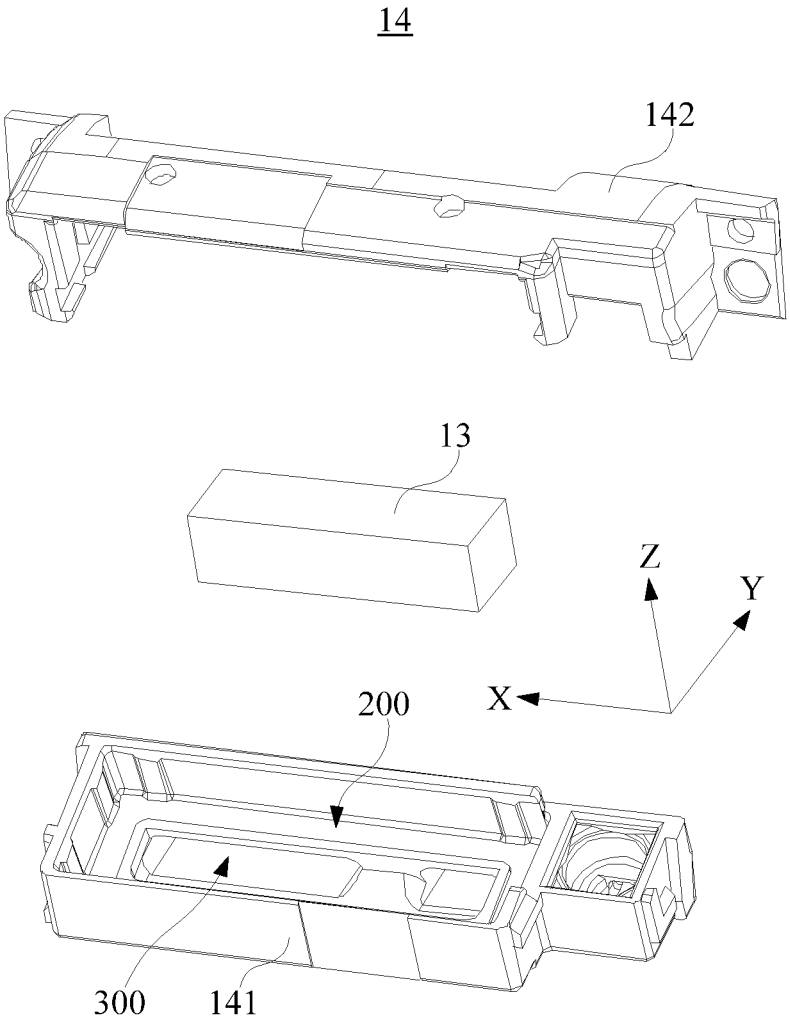
FIG. 3 is an exploded view of a fixation assembly according to the embodiment shown in FIG. 1.
Figure 4:
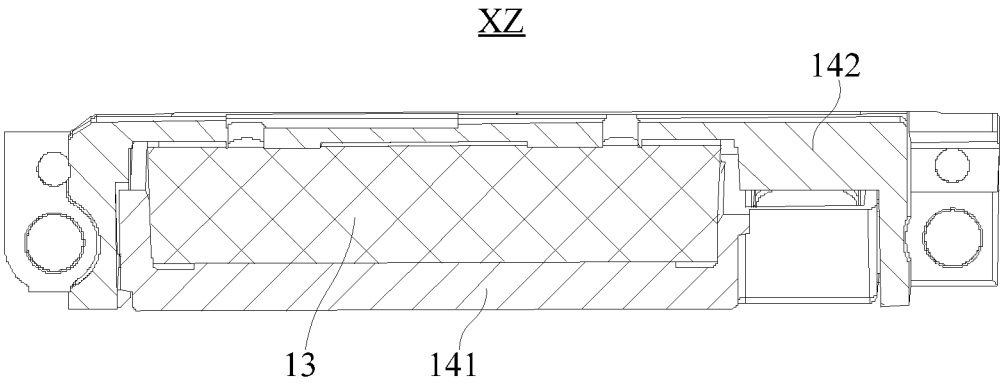
FIG. 4 is a cross sectional view taken along an XZ plane of the fixation assembly and the electroacoustic transducer after being engaged according to the embodiment shown in FIG. 3.

As shown in FIG. 3 and FIG. 4, FIG. 3 is an exploded view of the fixation assembly according to the embodiment shown in FIG. 1, and FIG. 4 is a cross sectional view taken along an XZ plane of the fixation assembly and the electroacoustic transducer after being engaged according to the embodiment shown in FIG. 3. It should be noted that showing the electroacoustic transducer in FIG. 3 is to illustrate a relative position between the electroacoustic transducer and the fixation assembly, in order to implicitly illustrate one of various potential engaging relations between the electroacoustic transducer and the fixation assembly. Further, all directional indications (such as top, under, left, right, front, back, etc.) in the present embodiment of the present disclosure are used to illustrate a relative positional relation and a motional situation of various elements when the electronic device is in a certain state. When the certain state is changed, the directional indications may be changed correspondingly.

As shown in FIG. 3, the fixation assembly 14 may include a first support 141 and a second support 142. The second support 142 may be engaged with the first support 141 by any one of or a combination of mounting, bonding, welding, threading, and so on. The first support 141 and the second support 142 may be engaged with each other to restrict freedom of the electroacoustic transducer 13. A material of the first support 141 and a material of the second support 142 may be metal, rigid plastics, and so on. The material of the first support 141 and the material of the second support 142 may be identical or different. In the present embodiment, as shown in FIG. 4, the second support 142 may be fastened with the first support 141, which will be described in more details hereinafter. The first support 141 and the second support 142 may clamp the electroacoustic transducer 13 to restrict the freedom of the electroacoustic transducer 13.

As shown in FIG. 3, the first support 141 may define a receiving space 200 and a sound transmission channel 300 communicating with the receiving space 200. The receiving space 200 may be defined for receiving the electroacoustic transducer 13. The sound transmission channel 300 may further communicate with the sound transmission hole 100. In this way, the sound generated by electroacoustic transducer 13 may be transmitted through the sound transmission channel 300 to the sound transmission hole 100, and the sound in the outer environment may be transmitted through the sound transmission hole 100 to the sound transmission channel 300 to reach the electroacoustic transducer 13. In this way, when the electroacoustic transducer 13 is received in the receiving space 200, and the second support 142 is fastened with the first support 141, as shown in FIG. 4, the fixation assembly 14 and the electroacoustic transducer 13 may be engaged together to form one structural assembly. In this situation, as the second support 142 and the first support 141 are engaged with each other to cooperatively restrict the freedom of the electroacoustic transducer 13, a relative position between the electroacoustic transducer 13 and the fixation assembly 14 may remain unchanged. Even when the electronic device is under the extreme condition, such as being dropped, being impacted, and so on, the electroacoustic transducer 13 and the fixation assembly 14 may not be misplaced.

Further, after the fixation assembly 14 and the electroacoustic transducer 13 are engaged together, the second support 142 may be arranged with the shell 12 (more specifically, the middle frame 122) by any one of a combination of mounting, bonding, welding, threading, and so on. In this way, the first support 141 and the electroacoustic transducer 13 may be fixed with the shell 12, and the sound transmission channel 300 may communicate with the sound transmission hole 100. In the present embodiment, the second support 142 may be arranged with the middle frame 122 by threading, which will be described in more details hereinafter. In this way, the freedom of the electroacoustic transducer 13 may be restricted by the fixation assembly 14 firstly, and subsequently, freedom between the fixation assembly 14 and the shell 12 may be restricted by fixed connection between the fixation assembly 14 and the shell 12, such that the electroacoustic transducer 13 and the shell 12 are fixed relative to each other, further improving the reliability of the electronic device 10 under the extreme condition, such as being dropped, impacted, and so on.

Figure 5:
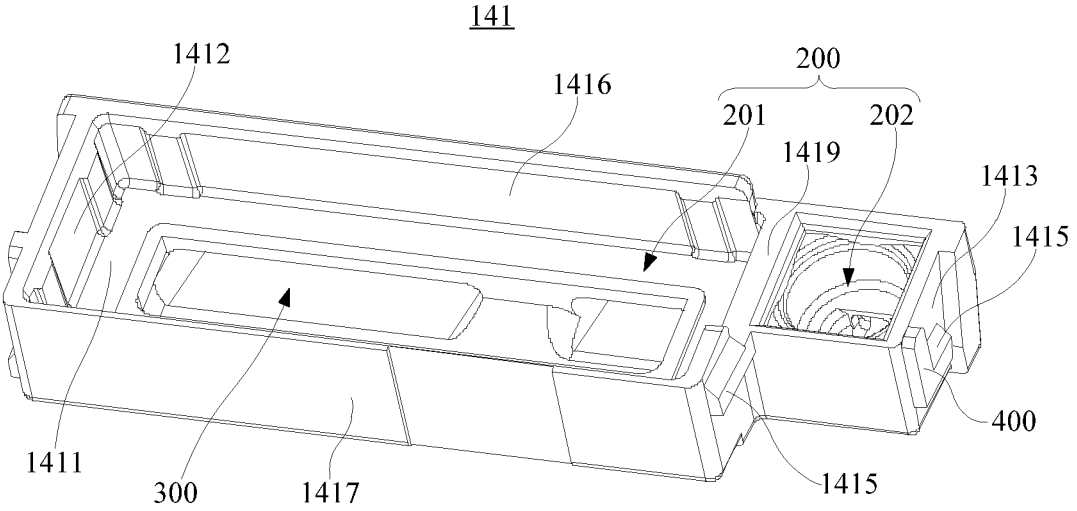
FIG. 5 is a schematic view of a first support from a viewing angle according to the embodiment shown in FIG. 3.
Figure 6:
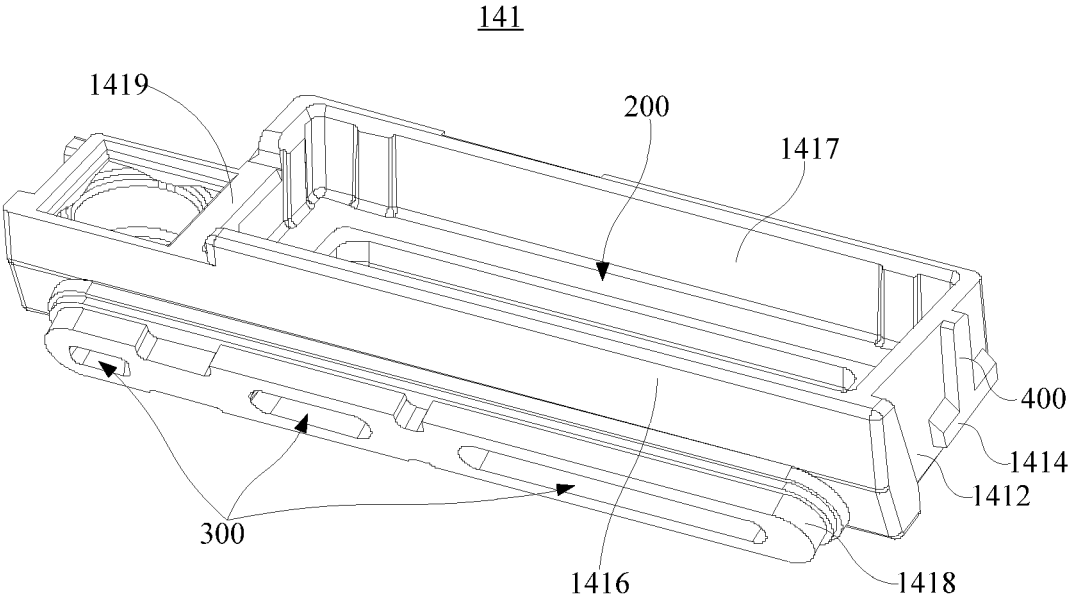
FIG. 6 is a schematic view of a first support from another viewing angle according to the embodiment shown in FIG. 3.

As shown in FIG. 5 and FIG. 6, FIG. 5 is a schematic view of the first support from a viewing angle according to the embodiment shown in FIG. 3, and FIG. 6 is a schematic view of the first support from another viewing angle according to the embodiment shown in FIG. 3.

The first support 141 may include a bottom wall 1411, a first side wall 1412, and a second side wall 1413, and the first side wall 1412 and the second side wall 1413 may be extending towards a same side of the bottom wall 1411. The first side wall 1412 and the second side wall 1413 may be disposed opposite to each other. The bottom wall 1411, the first side wall 1412, and the second side wall 1413 cooperatively define the receiving space 200. In the present embodiment, the sound transmission channel 300 may be defined in the bottom wall 1411, enabling the sound transmission channel 300 to communicate with the receiving space 200. Further, a face of the first side wall 1412 opposite to the receiving space 200 may be arranged with a first protrusion 1414. A face of the second side wall 1413 opposite to the receiving space 200 may be arranged with a second protrusion 1415. The first protrusion 1414 and the second protrusion 1415 may be configured to allow the second support 142 to fasten with the first support 141 easily, which will be described in more details hereinafter. In this way, before the electroacoustic transducer 13 is received in the receiving space 200, an adhesive (not shown in the figure) may be disposed on the electroacoustic transducer 13 and/or the bottom wall 1411, such that the electroacoustic transducer 13 may be adhered to the bottom wall 1411 via the adhesive. Therefore, a sealing effect between the electroacoustic transducer 13 and the first support 141 (more specifically, the bottom wall 1411) may be improved, and at the same time, the freedom of the electroacoustic transducer may be restricted at some extent. Subsequently, the second support 142 may be fastened with the first support 141, and the first support 141 and the second support 142 may cooperatively clamp the electroacoustic transducer 13, further restricting the freedom of the electroacoustic transducer 13.

In some embodiments, a distance between the first side wall 1412 and the second side wall 1413 may be equal to a size of the electroacoustic transducer 13 in a first direction (a direction indicated by the arrow X in FIG. 3), such that the freedom of the electroacoustic transducer 13 in the first direction may further be restricted by the first support 141.

The first support 141 may further include a third side wall 1416 and a fourth side wall 1417, which may be extending towards a same side of the bottom wall 1411. The third side wall 1416 and the fourth side wall 1417 may be disposed opposite to each other. The first side wall 1412, the second side wall 1413, the third side wall 1416, the fourth side wall 1417, and the bottom wall 1411 cooperatively define the receiving space 200. The four side walls of the first support 141 may correspond to four side walls of the electroacoustic transducer 13, such that the four side walls defining the receiving space 200 may be profiled to match an outer circumferential surface of the electroacoustic transducer 13. In this situation, the first support 141 may be a structure having an opening, and the electroacoustic transduce 13 may be received into the receiving space 200 through the opening. In this way, before the electroacoustic transducer 13 is received into the receiving space 200, the adhesive (not shown in the figure) may be disposed on the outer circumferential surface of the electroacoustic transducer 13 and/or corresponding walls (including the side walls and the bottom wall) of the receiving space 200, such that the electroacoustic transducer 13 may be adhered to the first support 141 via the adhesive. In this way, the sealing effect between the electroacoustic transducer 13 and the first support 141 may be improved, and at the same time, the freedom of the electroacoustic transducer 13 may be restricted at some extent.

In some embodiments, a distance between the third side wall 1416 and the fourth side wall 1417 may be equal to a size of the electroacoustic transducer 13 in a second direction (a direction indicated by the arrow Y in FIG. 3), such that the freedom of the electroacoustic transducer 13 in the second direction may further be restricted by the first support 141.

The first support 141 may further include a sealing portion 1418 protruding from the third side wall 1416. In details, the sealing portion 1418 may be configured to protrude from a face of the third side wall 1416 opposite to the receiving space 200. The sound transmission channel 300 is defined to further extend through the sealing portion 1418. In this way, when the second support 142 fixes the first support 141 and the electroacoustic transducer 13 with the shell 12, the sealing portion 1418 may abut against the shell 12, such that the sound transmission channel 300 may communicate with the sound transmission hole 100. A position at which the sealing portion 1418 is engaged to the shell 12 (more specifically, the middle frame 122) may be treated to be waterproof by disposing a seal ring, dispensing, and so on, such that the waterproof requirement of the electronic device may be met. Further, in order to improve adherence and fitting between the sealing portion 1418 and the middle frame 122 to improve the waterproof effect of the electronic device 10, the sealing portion 1418 may be fine machining, and particularly, a surface of the sealing portion 1418 adhering to and fitting with the middle frame 122 may be fine machining.

It should be noted that, as the sound transmission channel 300 may extend through the sealing portion 1418, the sealing portion 1418 may be ring-shaped. Therefore, in order to improve structural rigidity of the sealing portion 1418, at least one reinforcement rib may be arranged with the sealing portion 1418, and received in the sound transmission channel 300. However, at least one reinforcement rib may not disrupt communication between the sound transmission channel 300 and the sound transmission hole 100. In this situation, due to the reinforcement rib, the sound transmission channel 300 may be partitioned into a plurality of sub-channels not communicating with each other, such that the structural rigidity of the sealing portion 1418 and the sound transmission effect of the sound transmission channel 300 may be achieved at the same time. As shown in FIG. 6, due to the reinforcement rib of the sealing portion 1418, the sound transmission channel 300 may be partitioned into three sub-channels not communicating with each other, and each of the three sub-channels is communicating with the receiving space 200.

The first support 141 may further include a partition wall 1419. An end of the partition wall 1419 may be connected to the third side wall 1416, and the other end of the partition wall 1419 may be connected to the fourth side wall 1417, such that the receiving space 200 may be partitioned into a first receiving sub-space 201 and a second receiving sub-space 202. Each of the first receiving sub-space 201 and the second receiving sub-space 202 may be defined to receive the electroacoustic transducer 13. For example, the electroacoustic transducer 13 may include a loudspeaker portion and a microphone portion. The loudspeaker portion may be rectangular and received in the first receiving sub-space 201. The microphone portion may be cylindrical and received in the second receiving sub-space 202. In this way, the fixation assembly 14 may fix two portions of the electroacoustic transducer 13 to the shell 12, and waterproof requirement of the two portions of the electroacoustic transducer 13 may be met by the above-mentioned means.

Figure 7:
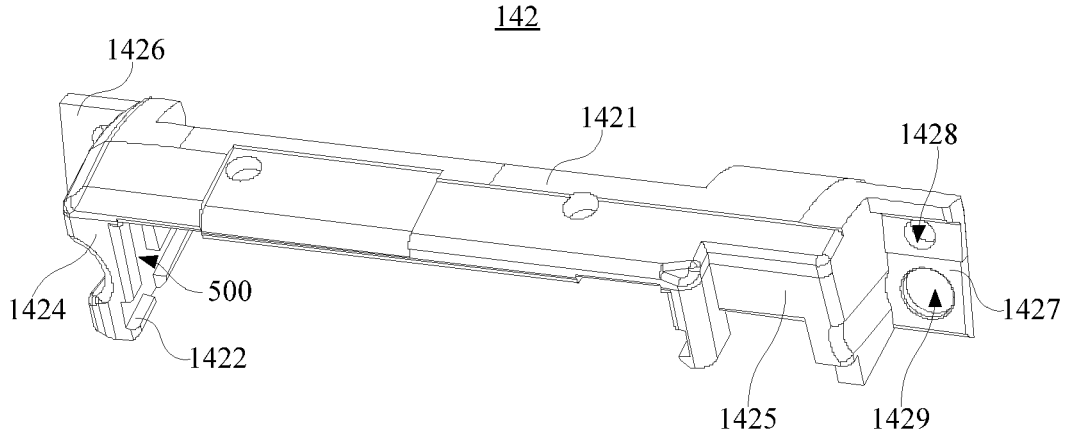
FIG. 7 is a schematic view of a second support from a viewing angle according to the embodiment shown in FIG. 3.
Figure 8:
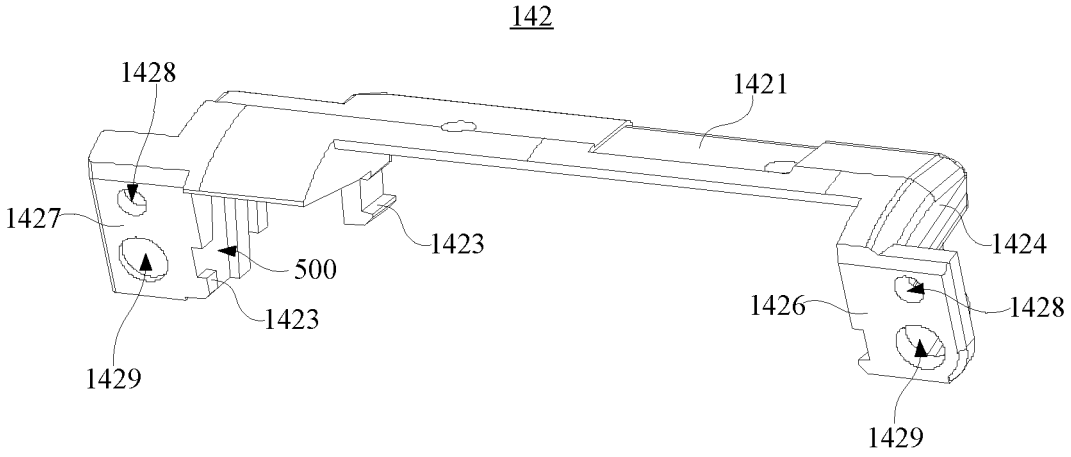
FIG. 8 is a schematic view of a second support from another viewing angle according to the embodiment shown in FIG. 3.

As shown in FIG. 7 and FIG. 8, FIG. 7 is a schematic view of the second support from a viewing angle according to the embodiment shown in FIG. 3, and FIG. 8 is a schematic view of the second support from another viewing angle according to the embodiment shown in FIG. 3.

The second support 142 may include a body portion 1421, a first barb 1422 connected to the body portion 1421, and a second barb 1423 connected to the body portion 1421. The first barb 1422 may correspond to the first protrusion 1414 on the first support 141, and the second barb 1423 may correspond to the second protrusion 1415 of the first support 141. The first barb 1422 and the second barb 1423 may extend towards each other, such that the second support 142 may be fastened with the first support 141. In this way, when the second support 142 is fastened with the first support 141, the body portion 1421 may be configured to cross over the first side wall 1412 and the second side wall 1413, the first barb 1422 may be fastened with the first protrusion 1414, and the second barb 1423 may be fastened with the second protrusion 1415. That is, the body portion 1421 covers the face of the first side wall 1412 opposite to the receiving space 200 and the face of the second side wall 1413 opposite to the receiving space 200. Further, a distance between the body portion 1421 and the bottom wall 1411 along a third direction may be equal to a size of the electroacoustic transducer 13 in the third direction (a direction indicated by the arrow Z in FIG. 3), such that the freedom of the electroacoustic transducer 13 in the third direction may further be restricted by the first support 141 and the second support 142 cooperatively. In this way, when the electroacoustic transducer 13 is received in the receiving space 200, and when the second support 142 is fastened with the first support 141, the first support 141 and the second support 142 may clamp the electroacoustic transducer 13, such that the freedom of the electroacoustic transducer 13 may further be restricted, further improving the reliability of the electronic device 10 under the extreme condition, such as being dropped, impacted, and so on.

It should be noted that, as the electroacoustic transducer 13 and/or the bottom wall 1411 may be arranged with the adhesive, when determining the distance between the body portion 1421 and the bottom wall 1411, a thickness of the adhesive in the third direction may also be considered in addition to the size of the electroacoustic transducer 13 in the third direction, such that the electroacoustic transducer 13 and the adhesive may be fit between the first support 141 and the second support 142 in the third direction, and the second support 142 may be fastened with the first support 141 and may also clamp the electroacoustic transducer 13 cooperatively with the first support 141. Further, the partition wall 1419 may be arranged with the first support 141 to partition the receiving space 200 into the first receiving sub-space 201 and the second receiving sub-space 202, and structural parameters, such as sizes, shapes, and so on, of the first receiving sub-space 201 and the second receiving sub-space 202 may be identical or different. For example, in the second direction of the electroacoustic transducer 13, a size of the partition wall 1419 may be greater than a size of the second side wall 1413, i.e. a part of the partition wall 1419 may be out of the second receiving sub-space 202, the part of the partition wall 1419 may be configured to define the first receiving sub-space 201 but may not be configured to define the second receiving sub-space 202. In order to improve the reliability of the second support 142 being fastened with the first support 141, in addition to the face of the second side wall 1413 opposite to the receiving space 200 being arranged with the second protrusion 1415, a face of the partition wall 1419 opposite to the first receiving sub-space 201 may also be arranged with the second protrusion 1415. For example, the second protrusion 1415 may be arranged on the part of the partition wall 1419 out of the second receiving sub-space 202. In this situation, the second support 142 may be arranged with two second barbs 1423 correspondingly. One of the two barbs 1423 corresponds to the second protrusion 1415 arranged on the second side wall 1413, and the other one of the two barbs 1423 corresponds to the second protrusion 1415 arranged on the partition wall 1419.

According to the above description, a direction of the second support 142 being fastened with the first support 141 may be the direction indicated by the arrow Z in FIG. 3. In details, the first barb 1422 may be fastened with the first protrusion 1414 along the third direction of the electroacoustic transducer 13, and the second barb 1423 may be fastened with the second protrusion 1415 along the third direction of the electroacoustic transducer 13. Further, after the first support 141 and the second support 142 clamp the electroacoustic transducer 13, the fixation assembly 14 may be engaged with the shell along any one of the first direction, the second direction, and the third direction, it is only required to adjust the corresponding engaging structure on the second support 142. In the embodiment of the present disclosure, an example will be described hereinafter, where a direction along which the second support 142 is fastened with the first support 141 is different from a direction along which the second support 142 is engaged to the shell 12.

Hereinafter, the second support 142 being engaged to the shell 12 along the second direction of the electroacoustic transducer 13 may be illustratively described.

The second support 142 may further include a first connection portion 1424 and a second connection portion 1425, which are connected to a same side of the body portion 1421. The first connection portion 1424 and the second connection portion 1425 are disposed opposite to each other. The first barb 1422 may be disposed on an end of the first connection portion 1424 away from the body portion 1421. The second barb 1423 may be disposed on an end of the second connection portion 1425 away from the body portion 1421. Further, the first connection portion 1424 may be configured to adjust a distance between the first barb 1422 and the body portion 1421, and the second connection portion 1425 may be configured to adjust a distance between the second barb 1423 and the body portion 1421. In this way, a position of the first barb 1422 may be adapted to a position of the first protrusion 1414 spatially, and a position of the second barb 1423 may be adapted to a position of the second protrusion 1415 spatially. In this way, when the second support 142 is fastened with the first support 141, the first barb 1422 and the second barb 1423 may be fastened with the first protrusion 1414 and the second protrusion 1415 respectively, and the first support 141 and the second support 142 may clamp the electroacoustic transducer 13.

The second support 142 may further include a first engaging portion 1426 and a second engaging portion 1427. The first engaging portion 1426 may be connected to the first connection portion 1424, and the second engaging portion 1427 may be connected to the second connection portion 1425. The first engaging portion 1426 and the second engaging portion 1427 may be fixed to the middle frame 122 by threading, such that the second support 142 may be engaged with the shell 12. In details, each of the first engaging portion 1426 and the second engaging portion 1427 may define a positioning hole 1428 and a second mounting hole 1429. A position in which the positioning hole 1428 is defined and a position at which the positioning post 1221 is configured may be adapted to each other spatially. The positioning post 1221 may be received in the positioning hole 1428 with an interference fit or a transition fit, such that a positioning effect may be achieved while the second support 142 is being engaged with the shell 12, such that engaging accuracy between the second support 142 and the shell 12 may be improved. Further, a position in which the second mounting hole 1429 is defined and a position in which the first mounting hole 1222 is defined may be adapted to each other spatially, such that the second support 142 may be fixed to the middle frame 122 through a screw. In this way, after the first support 141 and the second support 142 clamp the electroacoustic transducer 13, and after the second support 142 is engaged with the shell 12, the freedom of the first support 141 may be restricted by the second support 142 and the shell 12. In this way, the relative position between the first support 141 and the shell 12 may remain unchanged, even when the electronic device 10 is under the extreme condition, such as being dropped, impacted, and so on, the first support 141 and the shell 12 may not be misplaced. Therefore, the reliability of the electronic device 10 may be improved, when the electronic device 10 is under the extreme condition, such as being dropped, impacted, and so on.

Further, as the second support 142 is fastened with the first support 141 along the third direction of the electroacoustic transducer 13, whereas the second support is fastened with the shell 12 along the second direction of the electroacoustic transducer 13, the direction along which the first engaging portion 1426 is engaged with the shell 12 may be perpendicular to the direction along which the first barb 1422 is fastened with the first protrusion 1414, and the direction along which the second engaging portion 1427 is engaged with the shell 12 may be perpendicular to the direction along which the second barb 1423 is fastened with the second protrusion 1415. In this situation, the first engaging portion 1426 and the second engaging portion 1427 may be fixed to the middle frame 122 along the second direction of the electroacoustic transducer 13.

It should be noted that, due to various factors, such as detailed structures of the electroacoustic transducer 13, the fixation assembly 14, and the shell 12, machining precision of each element, and so on, perpendicular relations described in the above may not be exactly 90°. In other words, the expression of perpendicular relations are used to distinct from a parallel relation.

Further, as shown in FIG. 5 and FIG. 8, the face of the first side wall 1412 opposite to the receiving space 200 and/or the face of the second side wall 1413 opposite to the receiving space 200 may be arranged with a guiding protrusion 400. In the present embodiment, an example will be illustratively described, where each of the face of the first side wall 1412 opposite to the receiving space 200 and the face of the second side wall 1413 opposite to the receiving space 200 is arranged with the guiding protrusion 400. Further, each of a face of the first connection portion 1424 opposite to the second connection portion 1425 and a face of the second connection portion 1425 opposite to the first connection portion 1424 defines a guiding groove 500 corresponding to the guiding protrusion 400. An extending direction of the guiding protrusion 400 and the guiding groove 500 may be parallel to the direction along which the second support 142 is fastened with the first support 141. That is, the guiding protrusion 400 and the guiding groove 500 are substantially extended along the third direction of the electroacoustic transducer 13. In this way, the guiding protrusion 400 may be received into the guiding groove 500 for guiding the second support 142 to fasten with the first support 141, such that engaging accuracy between the first support 141 and the second support 142 may be improved.

According to the above description, the direction along which the second support 142 is fastened with the first support 141 may be different from the direction along which the second support 142 being engaged with the shell 12. In details, the second support 142 may be fastened to the first support 141 along the third direction of the electroacoustic transducer 13, and the second support 142 may be engaged with the shell 12 along the second direction of the electroacoustic transducer 13. Obviously, the guiding protrusion 400 and the guiding groove 500 may not only exhibit an guiding effect while the second support 142 is fastening with the first support 141, but also exhibit a positioning effect while the second support 142 is engaging with the shell 12, such that the second support 142 may enable the first support 141 to abut against the shell 12, such that the sealing effect between the fixation assembly 14 and the shell 12 may be improved. Further, the guiding protrusion 400 and the guiding groove 500 may also exhibit the positioning effect while the electronic device 10 is under the extreme condition, such as being dropped, impacted, and so on, such that the first support 141 and the shell 12 may not be misplaced easily, and the reliability of the electronic device 10 under the extreme condition may be improved, such as being dropped, impacted, and so on.

The above descriptions are only a part of the embodiments of the present disclosure, and do not limit the scope of the present disclosure. Any equivalent device or equivalent process transformation performed by taking the contents of the description and drawings of the present disclosure, directly or indirectly applied in other related art, should also be included in the scope of the present disclosure.

What is claimed is:

1. A fixation assembly, configured to fix an electroacoustic transducer to a shell of an electronic device, the fixation assembly comprising:

a first support, defining a receiving space and a sound transmission channel communicating with the receiving space, wherein the electroacoustic transducer is received in the receiving space; and a second support, engaged with the first support and configured to restrict freedom of the electroacoustic transducer cooperatively with the first support, wherein the second support is configured with the shell to fix the first support and the electroacoustic transducer to the shell; and the sound transmission channel communicates with a sound transmission hole defined in the shell, wherein the second support is engaged with a side wall of the shell through a fixing member, wherein the side wall defines the sound transmission hole, wherein the first support comprises a bottom wall and a side wall connected to a periphery of the bottom wall, the bottom wall and the side wall of the first support cooperatively define the receiving space, and an opening of the receiving space faces towards a first direction, wherein the fixing member extends along a second direction from the second support towards the side wall of the shell, wherein the side wall of the shell extends along a plane, and wherein the first direction is parallel to the plane and is non-parallel to the second direction, and the second direction is non-parallel to the plane.

2. The fixation assembly according to claim 1, wherein the side wall of the first support comprises a first side wall and a second side wall;

the first side wall and the second side wall are connected to the bottom wall and extending towards a same side of the bottom wall, the first side wall and the second side wall are disposed opposite to each other;

the receiving space is defined by the first side wall, the second side wall, and the bottom wall;

the sound transmission channel is defined in the bottom wall;

a face of the first side wall opposite to the receiving space is configured with a first protrusion, a face of the second side wall opposite to the receiving space is configured with a second protrusion;

the second support comprises a body portion, a first barb, and a second barb;

the first barb and the second barb are connected to the body portion; and when the second support is fastened with the first support, the body portion is configured to cover the face of the first side wall opposite to the receiving space and the face of the second side wall opposite to the receiving space, the first barb is fastened with the first protrusion, and the second barb is fastened with the second protrusion.

3. The fixation assembly according to claim 2, wherein the second support further comprises a first connection portion and a second connection portion, the first connection portion and the second connection portion are connected to the body portion and extending towards a same side of the body portion;

the first connection portion and the second connection portion are disposed opposite to each other;

the first barb is disposed at an end of the first connection portion away from the body portion, the second barb is disposed at an end of the second connection portion away from the body portion;

the second support further comprises a first engaging portion and a second engaging portion;

the first engaging portion is connected to the first connection portion, the second engaging portion is connected to the second connection portion;

the first engaging portion and the second engaging portion are configured to engage with the shell;

a direction along which the first engaging portion is engaged with the shell is perpendicular to a direction along which the first barb is fastened with the first protrusion; and a direction along which the second engaging portion is engaged with the shell is perpendicular to a direction along which the second barb is fastened with the second protrusion.

4. The fixation assembly according to claim 3, wherein the face of the first side wall opposite to the receiving space is configured with a guiding protrusion, the face of the second side wall opposite to the receiving space is configured with another guiding protrusion;

a first face of the first connection portion defines a guiding groove corresponding to the guiding protrusion configured with the first side wall, the first face is opposite to the second connection portion;

a second face of the second connection portion is configured with another guiding groove corresponding to the other guiding protrusion configured with the second side wall, the second face is opposite to the first connection portion; and an extending direction of the guiding protrusion and an extending direction of the guiding groove are parallel to the direction along which the second support is fastened with the first support.

5. The fixation assembly according to claim 2, wherein the side wall of the first support further comprises a third side wall and a fourth side wall, the third side wall and the fourth side wall are connected to the bottom wall and extending towards a same side of the bottom wall, the third side wall and the fourth side wall are disposed opposite to each other, and the first side wall, the second side wall, the third side wall, the fourth side wall, and the bottom wall define the receiving space cooperatively.

6. The fixation assembly according to claim 5, wherein the first support further comprises a sealing portion, protruding from the third side wall;

the sealing portion is disposed at a face of the side wall opposite to the receiving space;

the sound transmission channel is further extended through the sealing portion; and when the second support fixes the first support and the electroacoustic transducer to the shell, the sealing portion is configured to abut against the shell, enabling the sound transmission channel to communicate with the sound transmission hole.

7. The fixation assembly according to claim 5, wherein the first support further comprises a partition wall connected to the bottom wall;

an end of the partition wall is connected to the third side wall, the other end of the partition wall is connected to the fourth side wall;

the receiving space is partitioned by the partition wall into a first receiving sub-space and a second receiving sub-space; and each of the first receiving sub-space and the second receiving sub-space is defined to receive the electroacoustic transducer.

8. An electronic device, comprising: a shell, an electroacoustic transducer, and a fixation assembly, wherein the shell defines a sound transmission hole;

the fixation assembly comprises a first support and a second support;

the first support defines a receiving space and a sound transmission channel communicating with the receiving space;

the electroacoustic transducer is received in the receiving space;

the second support is engaged with the first support and is configured to clamp the electroacoustic transducer cooperatively with the first support to restrict freedom of the electroacoustic transducer;

the second support is engaged with the shell to fix the first support and the electroacoustic transducer to the shell, enabling the sound transmission channel to communicate with the sound transmission hole;

the second support is engaged with a side wall of the shell through a fixing member, the side wall defining the sound transmission hole;

the first support comprises a bottom wall and a side wall connected to a periphery of the bottom wall, the bottom wall and the side wall of the first support cooperatively define the receiving space, an opening of the receiving space faces towards a first direction;

the fixing member extends along a second direction from the second support towards the side wall of the shell;

the side wall of the shell extends along a plane; and the first direction is parallel to the plane and is non-parallel to the second direction, and the second direction is non-parallel to the plane.

9. The electronic device according to claim 8, wherein the side wall of the first support comprises a first side wall, a second side wall, a third side wall, and a fourth side wall;

the first side wall, the second side wall, the third side wall, and the fourth side wall are connected to the bottom wall and are extending towards a same side of the bottom wall;

the bottom wall, the first side wall, the second side wall, the third side wall, and the fourth side cooperatively define the receiving space to receive the electroacoustic transducer; and the sound transmission channel is defined in the bottom wall.

10. The electronic device according to claim 9, wherein a face of the first side wall opposite to the receiving space is configured with a first protrusion, a face of the second side wall opposite to the receiving space is configured with a second protrusion;

the second support comprises a body portion, a first barb, and a second barb, the first barb and the second barb are connected to the body portion; and the body portion is configured to cover the face of the first side wall opposite to the receiving space and the face of the second side wall opposite to the receiving space, the first barb is fastened with the first protrusion, and the second barb is fastened with the second protrusion.

11. The electronic device according to claim 10, wherein the face of the first side wall opposite to the receiving space is configured with a guiding protrusion, the face of the second side wall opposite to the receiving space is configured with another guiding protrusion;

an end of the body portion close to the first barb defines a guiding groove corresponding to the guiding protrusion configured with the first side wall; and another end of the body portion close to the second barb defines another guiding groove corresponding to the guiding protrusion configured with the second side wall.

12. The electronic device according to claim 11, wherein the second support further comprises a first engaging portion and a second engaging portion;

the first engaging portion is connected to the end of the body portion close to the first barb, the second engaging portion is connected to the other end of the body portion close to the second barb;

the first engaging portion and the second engaging portion are configured to engage with the shell;

a direction along which the first engaging portion is engaged with the shell is perpendicular to a direction along which the first barb is fastened with the first protrusion; and a direction along which the second engaging portion is engaged with the shell is perpendicular to a direction along which the second barb is fastened with the second protrusion.

13. The electronic device according to claim 12, wherein the first support further comprises a sealing portion, protruding from a face of the third side wall opposite to the receiving space;

the sound transmission channel is defined in and extended through the sealing portion; and the sealing portion is configured to abut against the shell, allowing the sound transmission channel to communicate with the sound transmission hole.

14. The electronic device according to claim 13, wherein the first support further comprises a partition wall connected to the bottom wall;

an end of the partition wall is connected to the third side wall, the other end of the partition wall is connected to the fourth side wall;

the receiving space is partitioned by the partition wall into a first receiving sub-space and a second receiving sub-space; and a portion of the electroacoustic transducer is received in the first receiving sub-space, and a reset portion of the electroacoustic transducer is received in the second receiving sub-space.

15. The electronic device according to claim 14, wherein a part of the partition wall is disposed out of the second receiving sub-space and configured to define the first receiving sub-space;

another second protrusion is configured on the part of the partition wall out of the second receiving sub-space and is configured on a face of the part of the partition wall opposite to the first receiving sub-space; and the second support further comprises another second barb corresponding to the other second protrusion and able to fasten with the other second protrusion.

16. The electronic device according to claim 13, wherein the sealing portion comprises at least one reinforcement rib, the sound transmission channel is partitioned by the at least one reinforcement rib into a plurality of sub-channels, each of the plurality of sub-channels communicates with the sound transmission hole defined in the shell.

17. A wearable electronic device, comprising: a shell, an electroacoustic transducer, a fixation assembly, and a display module, wherein the display module is engaged with the shell to define a chamber to receive the fixation assembly;

the fixation assembly comprises first support and a second support, the first support and the second support are fastened with each other to define a receiving space, the electroacoustic transducer is received in the receiving space and is clamped by the first support and the second support cooperatively;

the shell defines a sound transmission hole, the first support defines a sound transmission channel communicating with the sound transmission hole and the receiving space;

the second support is engaged with a side wall of the shell through a fixing member, the side wall defining the sound transmission hole;

the first support comprises a bottom wall and a side wall connected to a periphery of the bottom wall, the bottom wall and the side wall of the first support cooperatively define the receiving space, an opening of the receiving space faces towards a first direction;

the fixing member extends along a second direction from the second support towards the side wall of the shell;

the side wall of the shell extends along a plane; and the first direction is parallel to the plane and is non-parallel to the second direction, and the second direction is non-parallel to the plane.

18. The wearable electronic device according to claim 17, wherein the second support is configured to engage with the shell to fix the first support and the electroacoustic transducer with the shell.

* * * * *